United States Patent [19]

Helvy

[11] Patent Number: 5,077,504

[45] Date of Patent: Dec. 31, 1991

[54] MULTIPLE SECTION PHOTOMULTIPLIER TUBE

[75] Inventor: Fred A. Helvy, Lancaster, Pa.

[73] Assignee: Burle Technologies, Inc., Wilmington, Del.

[21] Appl. No.: 615,292

[22] Filed: Nov. 19, 1990

[51] Int. Cl.[5] ..... H01J 43/18

[52] U.S. Cl. ..... 313/103 R; 313/532; 313/533

[58] Field of Search ..... 313/103, 532, 533, 535, 313/536

[56] References Cited

U.S. PATENT DOCUMENTS

| | | | |
|---|---|---|---|
| 3,633,270 | 1/1972 | Deradoorian | 29/592.1 |
| 3,668,388 | 6/1972 | Fisher et al. | 313/533 |
| 4,117,366 | 9/1978 | Davis | 313/524 |
| 4,881,008 | 11/1989 | Kyushima et al. | 313/532 |
| 4,937,506 | 6/1990 | Kimura et al. | 313/533 |

*Primary Examiner*—Donald J. Yusko
*Assistant Examiner*—Diab Hamadi
*Attorney, Agent, or Firm*—Martin Fruitman

[57] ABSTRACT

A multiple section photomultiplier tube constructed as a matrix of several independent tubes in one envelope. The photocathode to dynode spacings are isolated by a separator configuration built with walls which interlock in cooperating slots, and each photocathode operates with its own independent dynode cage. One dynode in each cage is maintained electrically independent, and its connection is brought out of the envelope independently. This permits independent adjustment of the gain for each of the tube's multiple sections, so they can be adjusted to the same response for a standard radiation signal. The entire tube can then be used to monitor a large area for radiation, and will yield the same response over its entire cathode area.

6 Claims, 3 Drawing Sheets

MULTIPLE SECTION PHOTOMULTIPLIER TUBE

SUMMARY OF THE INVENTION

This invention deals generally with electric lamp and discharge devices, and more specifically with a photomultiplier tube having plural anodes and a separate control electrode.

Photomultiplier tubes have become commonly used instruments for detecting low radiation levels. Typically they consist of a glass envelope with an electron emitting photocathode located on the inside surface of a faceplate on the envelope. When light strikes the photocathode, electrons emitted from it are directed toward and collected by an electron multiplier. The electron multiplier consists of several secondary electron emitting dynodes, the first of which receives the electrons from the photocathode. The several dynodes are usually located in a single grouping, frequently referred to as a dynode cage. The electron multiplier delivers its electrons to an anode which has an electrical output which is directly related to the quantity of electrons collected by the first dynode.

In order to maximize the collection efficiency of a tube, that is, to increase the ratio of electrons collected by the first dynode relative to the number emitted from the photocathode, focus electrodes are sometimes located between the photocathode and the first dynode. These electrodes are operated at various electrical potentials to create an electrical field between the photocathode and the first dynode. Multiple section photomultiplier tubes are not all that uncommon. They are particularly useful in radiation studies, including the study of light sources, in which the radiation falls on a large area, with different intensities, time sequences or patterns upon various portions of the area irradiated. While such fields can be studied by arrays of individual photomultiplier tubes when the radiation field is large enough, for small fields it is extremely difficult to construct tubes small enough and to pack individual tubes close enough to attain good definition and to avoid blocking out regions with the external envelopes of the adjacent tubes.

Multiple section photomultiplier tubes alleviate this problem by furnishing the effect of several tubes in one envelope. This permits closer packing of the active elements because the adjacent sections are not separated by portions of two envelopes. Several multiple section photomultiplier tubes are now available and are covered in the prior art, but they have problems which are not associated with the use of multiple independent tubes.

One problem is the need to construct and physically locate the multiple sections within a small envelope. The typical solution to this problem has been to structurally integrate the similar dynodes of the several sections and then to attempt to isolate them in terms of the electron optics of the tube sections, so that the sections will operate independently. This has not always been successful. "Crosstalk", that is, the interchange of electrons between tube sections, is a continuing source of problems in such tubes, and many designs have been proposed to counteract such crosstalk.

However, there is another problem with multiple section photomultiplier tubes which seems to have gone unnoticed, even though it is very real and actually present in every such tube. It occurs because no two sections of a multiple section photomultiplier tube, or for that matter, no two tubes of a group of tubes, can actually be expected to have exactly the same characteristics in regard to the electrical signals generated at the anode for the same quantity of radiation activating the photocathodes. Therefore, each section of a multiple section photomultiplier tube will usually yield a different signal, even if the same amount of radiation is hitting each cathode.

In practical equipment this variation in output is counteracted by the use of gain adjustments in subsequent signal processing, so that, for instance, the gains of amplifiers which process the signal from each individual section of the photomultiplier tube are adjusted so that the output of each amplifier is the same for a standard radiation signal onto each section's photocathode. Clearly, this adds an unnecessary complexity to the equipment which would not be required if the photomultiplier sections themselves could be made to all have the same characteristics.

The present invention accomplishes the goal of equal output signals from each section of a multiple section photomultiplier tube by means of simple modifications to the tube structure and to the tube electrode voltage sources, which are already available, and thereby eliminates the need for adjustment capability in the signal processing circuits which follow the photomultiplier tube.

The multiple section photomultiplier tube of the present invention differs from the conventional multiple section photomultiplier tube in that it has one dynode of each of the several electron multiplier sections electrically isolated and completely independent of the similar dynodes of the other sections. The prior art multiple section photomultiplier tubes are all constructed so that each dynode of each section of the tube is electrically interconnected with all the other similar dynodes. That is, all the first dynodes of all the sections are electrically connected together, all the second dynodes of all the sections are electrically connected together, and so forth.

In the present invention, the dynodes in one such set, the fifth dynode is the one selected in the preferred embodiment, are not electrically connected to any of the other like numbered dynodes, and each such dynode is connected to an independent pin in the tube base which penetrates the envelope, and can be independently connected to a voltage source. All the dynodes other than the one selected to be independent are conventionally interconnected among the sections, so that the other like numbered dynodes in all the sections are all electrically connected to each other.

The isolation of one dynode from each section permits independently adjusting the voltage applied to each of these independent dynodes, and this independent voltage adjustment of even only one dynode's voltage acts as a gain adjustment, that is, an adjustment of the photomultiplier section's output for a particular radiation input, for the electron multiplier within which that dynode is located. It is therefore possible to adjust the gain on each photomultiplier section, since each section has at least one electrically isolated dynode, and to balance or equalize the gains of all the sections, so that a standard radiation level on each section's photocathode yields exactly the same electrical signal from each section's anode as the signal being generated by all the other sections.

By this means, the multiple section photomultiplier tube of the invention improves upon the prior art tubes by yielding a standardized signal from all of its sections and, therefore it does not require any gain adjustments in the later signal processing stages.

The voltages for the independent dynodes of each section are quite easily available by a minor modification of the conventional dynode voltage source. Since the conventional source of dynode voltages is a voltage divider with fixed connections determining the voltages for each group of dynodes, it is only necessary to connect multiple parallel potentiometers in place of the resistor which would otherwise be used to determine the voltage of the dynodes which have been electrically isolated. Then the variable arm connection of each one of the potentiometers is connected to a pin of the photomultiplier base to which an independent dynode is connected, and the adjustment of each potentiometer furnishes an appropriate variable voltage to each independent dynode.

The present invention therefore replaces, in a very simple manner, the function of a great many adjustable gain amplifiers which would otherwise be required. This benefit can be better appreciated when it is noted that the preferred embodiment of the invention is a sixteen section photomultiplier tube, and that the present invention thereby replaces sixteen variable gain amplifiers with only sixteen potentiometers, which are passive components. The increase in reliability and decrease in cost is apparent.

DETAILED DESCRIPTION OF THE INVENTION

Figure 1:
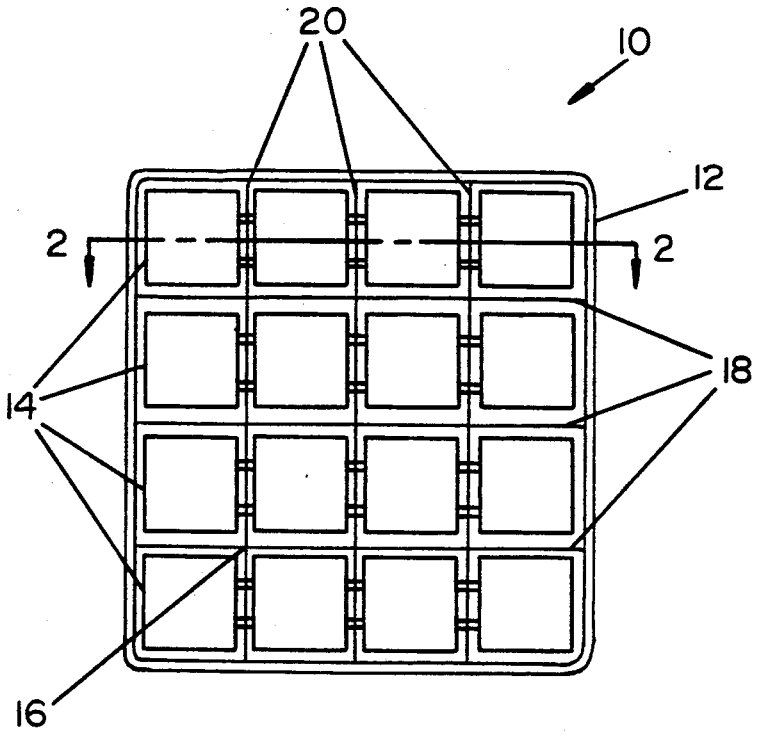
FIG. 1 is a plan view of the faceplate of the multiple section photomultiplier tube of the preferred embodiment.

FIG. 1 is a plan view of faceplate 12 of multiple section photomultiplier tube 10 of the preferred embodiment. It is essentially the view seen from the radiation or light source (not shown) which illuminates faceplate 12. Faceplate 12 is part of the vacuum envelope of photomultiplier tube 10, and on the backside of faceplate 12, within photomultiplier tube 10, are located the photocathodes of each of the sixteen sections of photomultiplier tube 10. Each of the sixteen sections 14 of photomultiplier tube 10 are actually mechanically separate, complete photomultiplier tubes which could operate as such if they were located within separate envelopes.

Although separate sections 14 are electrically interconnected in many respects, the electron optics system of each of the sections is isolated from all of the other sections to eliminate crosstalk between sections. One of the means of accomplishing this isolation is the use of shield structure 16 between sections 14. Shield structure 16 is actually built from six individual dividers, with three parallel dividers 18 located behind and oriented across faceplate 12, and three other parallel dividers 20 interlocking with dividers 18 and oriented perpendicular to dividers 18.

The interlocking structure of dividers 18 and 20 is accomplished quite simply by use of the classic "egg crate" structure. In that structure, each intersection is constructed by forming facing slots in the intersecting dividers for half the width of each divider, and then pushing the slots of the intersecting dividers together until the edges of the dividers meet. Such a shield structure 16 is essentially self locating and need only be spot welded at the intersections to form a rigid structure.

Figure 2:
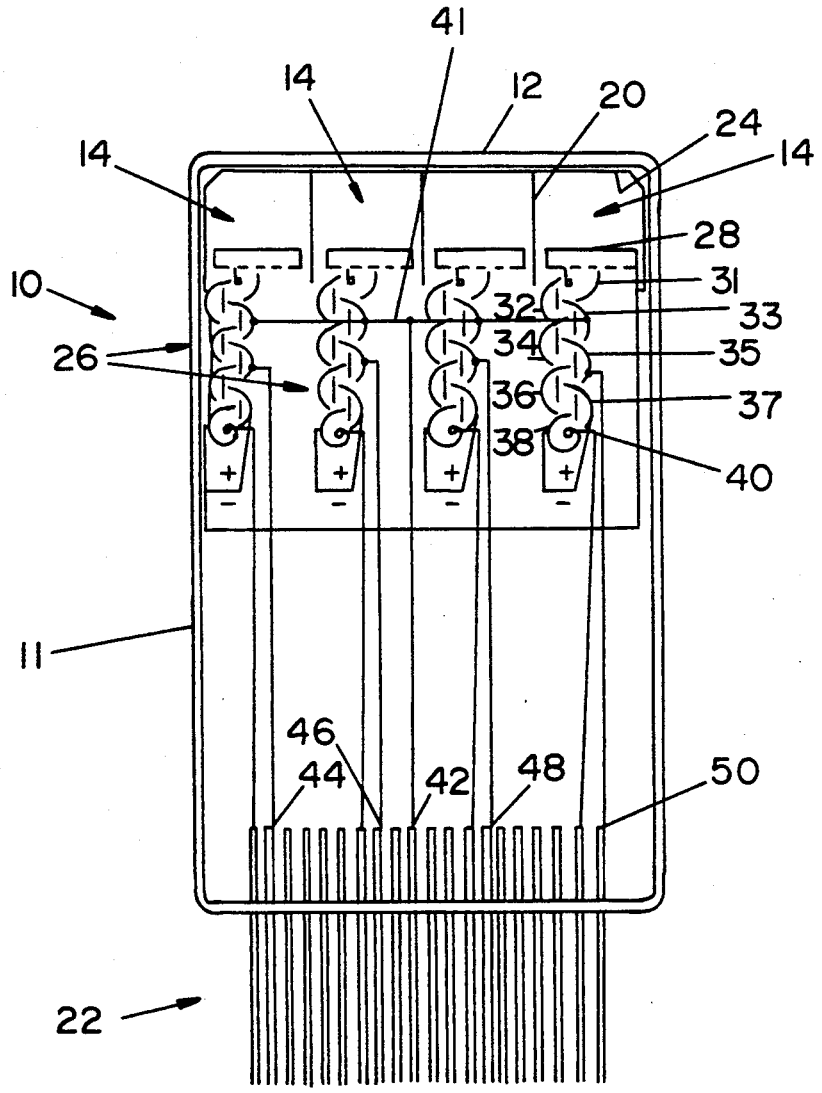
FIG. 2 is a cross section view through a longitudinal plane of the photomultiplier tube of the preferred embodiment.

FIG. 2 is a cross section view of photomultiplier tube 10 along a longitudinal plane through one set of four tube sections 14, as indicated by section line 2—2 in FIG. 1. Conventional photomultiplier tube sections 14 are depicted in simplified schematic form in order to illustrate the unique interconnection of the various electrodes among multiple sections 14, which is the essence of the invention. For easier reading of the FIG. 2, and because all tube sections 14 are identical, only one such section's parts are identified with numerals.

In FIG. 2, multiple section photomultiplier tube 10 is shown conventionally constructed with vacuum tight envelope 11 which has faceplate 12 at one end and numerous connecting pins 22 at the other end. On the inside of faceplate 12 are located photocathodes 24 for each of the sixteen sections 14, and dividers 20 separate the regions of sections 14 between photocathodes 24 and dynode cages 26. Each tube section 14 has not only its own separate photocathode 24 and dynode cage 26, but also all its own other electrodes, so that effectively there are sixteen tubes constructed in one envelope.

Following through on only the rightmost section 14 of tube 10 shown in FIG. 2, below photocathode 24 is located focusing electrode 28, although such an electrode need not exist in all photomultiplier tubes, and is not an essential part of the present invention.

The several dynodes of each section are shown below focusing electrode 28. The group of dynodes comprise the electron multiplier portion of a photomultiplier tube and their physical configuration is sometimes referred to as the dynode cage. The conventional designation used for the dynodes is numerical, with number one nearest the photocathode and the numbers increasing as the dynodes move closer to the anode. This numerical sequence follows in the same direction as the electrons progress through the electron multiplier. In the preferred embodiment shown in FIG. 2, there are eight dynodes in each tube section with dynode number one designated 31 and the other dynodes identified as 32–38, with dynode number eight being 38 located nearest to anode 40.

As is common with such multiple section photomultiplier tubes most of the dynodes in the several sections are interconnected with other similarly numbered dynodes in the other sections. This is illustrated in FIG. 2 by the interconnection shown between the several dynodes 33, dynode number 3 in each section. These dynodes are all electrically connected by wire 41, and a connection is brought out to only one connecting pin 42.

However, the present invention differs from the conventional structures of the prior art in one major respect. In the present invention, one dynode in each of the sections is kept isolated from all the others in the other sections. In FIG. 2 this is illustrated with dynode 35, number five in each of the four sections shown. These dynodes are each isolated from each other and connected only to their own related connecting pins, 44, 46, 48 and 50. It is this unique structure which permits each of these isolated dynodes to be supplied with an independent voltage, and therefore multiple sections 14 can be adjusted so that each has the same characteristics as all the others.

Figure 3:
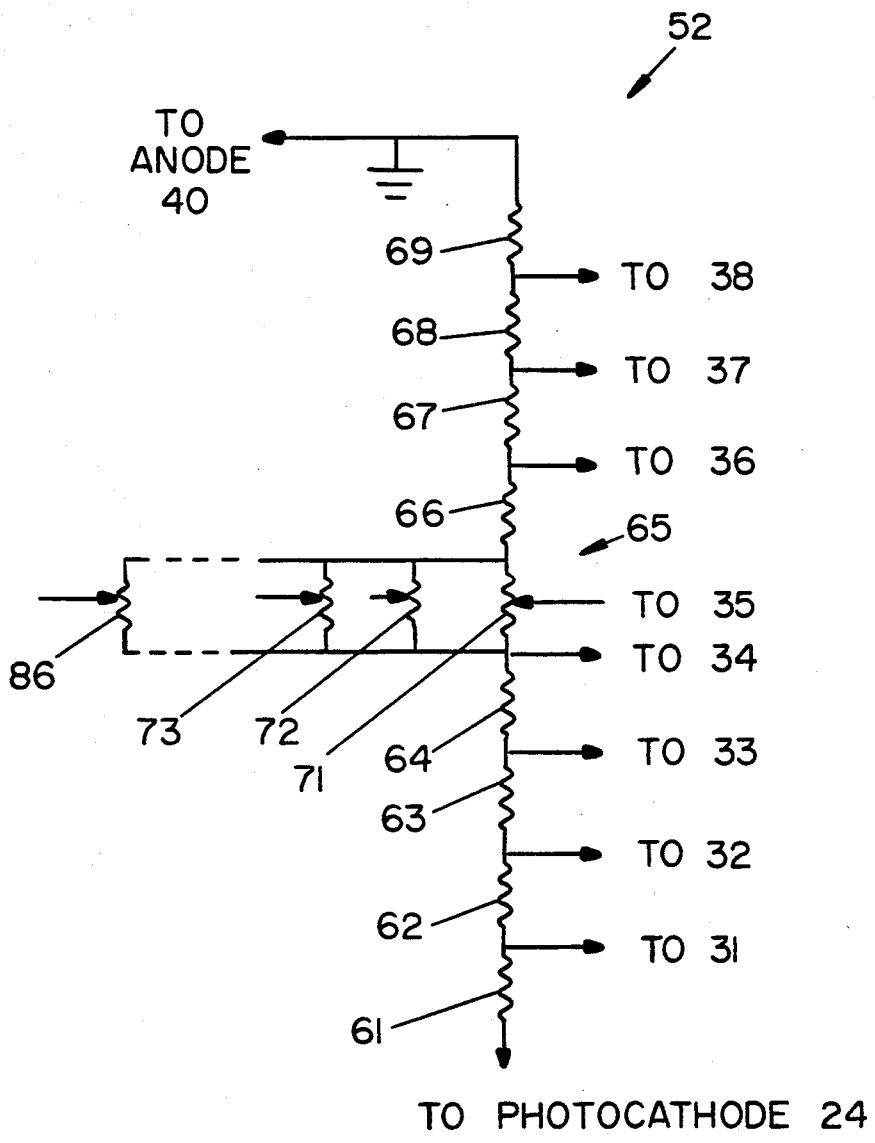
FIG. 3 is a schematic diagram of the voltage divider used to supply independent dynode voltages to the photomultiplier of the preferred embodiment.

FIG. 3 is a simplified schematic diagram of voltage divider 52 which is used to furnish voltages to all the dynodes of photomultiplier tube 10 and also to adjust the voltages on independent dynodes 35 in order to equalize the gain characteristics of all the tube sections. For the preferred embodiment, voltage divider 52 is constructed of eight resistor sections, 61 through 68, connected in series, and resistor sections 61–64 and 66–69 are single resistors. As is conventional, the number of resistor sections in voltage divider 52 is one more than the number of dynodes in each of the electron multipliers of photomultiplier tube 10, and while it is conventional practice to connect voltage divider 52 between the photocathodes 24 and anodes 40, any appropriate voltage sources can be used.

Resistor section 65, however, is not a conventional single resistor, but instead is a group of parallel connected potentiometers, 71, 72, 73, 74 etc. There are as many parallel connected potentiometers in resistor section 65 as there are independent dynodes 35 within multiple section photomultiplier tube 10, so that in the preferred embodiment there would be sixteen potentiometers. Thus, each such independent dynode 35 has a potentiometer associated with it. The adjustable arm of each potentiometer is connected to a separate pin in pin group 22 at the base of tube 10, and each independent dynode 35 of tube 10 is also connected to one of those same pins. Thereby, the variable voltage available from each of the potentiometers can be applied to an independent dynode 35 in one of the multiple sections 14 of tube 10, and the gain characteristic of each of the multiple sections can be adjusted so that all the sections can yield equal output signals for a standard radiation input.

This feature is not available in any other multiple section photomultiplier tube, and it furnishes the distinct advantage of a standardized gain among all the sections of a multiple section photomultiplier tube. The present invention, therefore, does not require additional subsequent signal processing stages to accomodate to different gain characteristics in each tube section.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the number of sections, the number of dynodes in each section, the particular dynode selected as the independent one, and the specific other electrodes used within multiple section photomultiplier tube 10 may be changed. The present invention is clearly applicable to any photomultiplier tube with more than a single section. Moreover, the specific sources of the variable voltages connected to independent dynodes 35 may also be varied.

What is claimed as new and for which Letters Patent of the U.S. are desired to be secured is:

1. A photomultiplier tube constructed within a single vacuum envelope comprising:

at least two sections, each section including a photocathode, an anode which is independent of the anodes in each other section, and an electron multiplier, with each section capable of furnishing an electrical signal from its anode and the anode signal being related to the radiation affecting that section's photocathode;

with each section's electron multiplier comprising at least two dynodes, and each section's electron multiplier including at least one dynode which is electrically isolated from the similarly oriented dynodes of all the other sections, and with each such electrically isolated dynode connected to an independent connector pin which penetrates the vacuum envelope of the photomultiplier tube; and each section's other dynodes, which are not electrically isolated dynodes, being electrically interconnected to the similarly oriented dynodes of other electron multipliers within the tube, with each such group of interconnected dynodes connected to at least one connector pin which penetrates the vacuum envelope of the photomultiplier tube.

2. The photomultiplier tube of claim 1 wherein the photocathodes of all the sections are located on a single faceplate of the photomultiplier tube.

3. The photomultiplier tube of claim 1 wherein a shield structure is included within the tube to isolate at least part of each section from the other sections, and said shield structure is located in a region between the photocathodes and the electron multipliers of the sections of the tube.

4. The photomultiplier tube of claim 3 wherein the shield structure comprises at least two dividers oriented in planes which are perpendicular to each other and transverse to the photocathodes of the sections.

5. The photomultiplier of claim 4 wherein the dividers interlock together at slots formed in each of the dividers.

6. The photomultiplier of claim 5 wherein the slots in the dividers extend half the width of the dividers.

* * * * *